US009322418B2

(12) United States Patent
Knecht

(10) Patent No.: US 9,322,418 B2
(45) Date of Patent: Apr. 26, 2016

(54) ROTARY ACTUATOR WITH HYDRAULIC VALVE

(71) Applicant: Hilite Germany GmbH, Marktheidenfeld (DE)

(72) Inventor: Andreas Knecht, Kusterdingen (DE)

(73) Assignee: Hilite Germany GmbH, Marktheidenfeld (DE)

( * ) Notice: Subject to any disclaimer, the term of this patent is extended or adjusted under 35 U.S.C. 154(b) by 456 days.

(21) Appl. No.: 13/917,095

(22) Filed: Jun. 13, 2013

(65) Prior Publication Data

US 2014/0157980 A1 Jun. 12, 2014

(30) Foreign Application Priority Data

Jul. 6, 2012 (DE) ..... 10 2012 106 096

(51) Int. Cl.

| | |
|---|---|
| ***F15B 13/044*** | (2006.01) |
| ***F15B 15/12*** | (2006.01) |
| ***F01L 1/344*** | (2006.01) |
| *F01L 1/047* | (2006.01) |

(52) U.S. Cl.

CPC ..... *F15B 15/12* (2013.01); *F01L 1/3442* (2013.01); *F01L 2001/0475* (2013.01); *F01L 2001/34423* (2013.01); *F01L 2001/34426* (2013.01); *F01L 2001/34433* (2013.01)

(58) Field of Classification Search

CPC ..... F15B 15/12; F01L 1/3442; F01L 2001/34426; F01L 2001/34433; F01L 2001/34423

USPC ..... 137/625.2, 625.64, 625.22, 625.23, 137/625.43, 625.46, 625.47, 625.21, 137/596.16, 596.17; 92/122, 125

See application file for complete search history.

(56) References Cited

U.S. PATENT DOCUMENTS 4,469,134 A * 9/1984 Kanai ..... F16K 11/065 137/596.17

FOREIGN PATENT DOCUMENTS

| | | | |
|---|---|---|---|
| DE | 3810804 | A1 | 10/1989 |
| DE | 196 37 174 | A1 | 3/1997 |
| DE | 198 23 619 | A1 | 12/1999 |
| DE | 198 53 670 | A1 | 5/2000 |
| DE | 10 2004 038 252 | A1 | 12/2005 |
| DE | 10 2005 041 393 | A1 | 3/2007 |
| DE | 10 2006 012 733 | A1 | 9/2007 |

* cited by examiner

*Primary Examiner* — Nathaniel Wiehe
*Assistant Examiner* — Dustin T Nguyen
(74) *Attorney, Agent, or Firm* — Von Rohrscheidt Patents

(57) ABSTRACT

A rotary actuator including a hydraulic valve including a borehole with shoulders, and a first operating connection and a second operating connection originating from the borehole, wherein a pressure balanced hollow piston is arranged axially movable in the borehole, wherein the hollow piston is fitted with a first outer diameter in a borehole section in a sealing manner, wherein the hollow piston includes the following axially subsequent to the first outer diameter: an enveloping surface with a large outer diameter in an axial portion of the first operating connection, and an enveloping surface with a small outer diameter in an axial portion of the second operating connection, wherein an inlet edge and an outlet edge extends from each of the first enveloping surface and the second enveloping surface, wherein the two inlet edges are oriented away from one another and the two outlet edges are oriented towards one another.

11 Claims, 3 Drawing Sheets

ROTARY ACTUATOR WITH HYDRAULIC VALVE

RELATED APPLICATION

This application claims priority from and incorporates by reference German patent application DE 10 2012 106 096.7 filed on Jul. 6, 2012.

FIELD OF THE INVENTION

The invention relates to a rotary actuator with a hydraulic valve according to patent claim 1.

BACKGROUND OF THE INVENTION

A hydraulic valve for a rotary actuator is already known from DE 10 2005 041 393 A1. According to the invention, the hydraulic valve includes a piston that is arranged longitudinally movable in a bore. A pressure medium connection P and two operating connections A and B axially directly subsequent to the pressure medium connection originate from an inner wall of the valve. The piston includes a pressure cavity inlet channel and a pressure cavity outlet channel arranged separate from the pressure cavity inlet channel. The piston shall be producible according to one embodiment from plastic material or through a powder metal injection molding method. A metal injection molding method is recited as an embodiment.

DE 196 37 174 A1 illustrates a hydraulic valve for a rotary actuator in which a piston is arranged longitudinally movable within a borehole with a longitudinal axis. Two operating connections A, B and a pressure medium connection P originate from the inner wall of the borehole. The pressure medium connection P is thus arranged between the two operating connections A, B.

A hydraulic valve for a rotary actuator is also known from DE 198 53 D20 B4. Two operating medium connections A, B and a tank outlet T originate from an inner wall of a bore. Thus, the tank outlet T is arranged axially between the two operating connections A, B. A pressure medium connection P arranged at a face of the hydraulic valve provides pressure from an inside to the borehole or the hollow piston.

Another hydraulic valve for a rotary actuator is known from DE 10 2004 038 252 A1. A pressure medium connection P, a tank outlet T and two operating connections A, B originate in axial sequence from an inner wall of the bore.

BRIEF SUMMARY OF THE INVENTION

Thus, it is an object of the invention to provide a rotary actuator with a hydraulic valve whose pressure medium connection P and both operating connections A, B are arranged axially adjacent on a common side.

The object is achieved according to the invention through A rotary actuator, including a hydraulic valve including a borehole with shoulders, and a first operating connection and a second operating connection originating from the borehole, wherein a pressure balanced hollow piston is arranged axially movable in the borehole, wherein the hollow piston is fitted with a first outer diameter in a borehole section in a sealing manner, wherein the hollow piston includes the following axially subsequent to the first outer diameter: an enveloping surface with a large outer diameter in an axial portion of the first operating connection, and an enveloping surface with a small outer diameter in an axial portion of the second operating connection, wherein an inlet edge and an outlet edge extends from each of the first enveloping surface and the second enveloping surface, wherein the two inlet edges are oriented away from one another and the two outlet edges are oriented towards one another so that a supply pressure introduced into a cavity of the hollow piston loads a projected circular surface which is formed by the small outer diameter so that a force is effective in an axial direction, wherein the supply pressure on the other hand side loads a projected annular surface which is formed by the large outer diameter minus the first outer diameter.

According to one embodiment of the invention, the first operating connection A (B) is arranged directly after the pressure medium connection P. The second operating connection B (A) is arranged directly or indirectly subsequent to the first operating connection A. Indirectly means that a tank outlet T can be arranged between the two operating connections A, B. Due to the directly or indirectly adjacent arrangement of the two operating connections A, B, the rotary actuator can be configured axially narrow for a hydraulic valve that is for example centrally arranged with respect to the rotary actuator. The designation of the two operating connections A and B is therefore arbitrary.

According to another embodiment of the invention, the pressure medium connection P is arranged axially behind or in front of the two operating connections A, B. Thus, the pressure medium connection P can be connected outside of the rotary actuator to channels in the hydraulic valve which channels can feed the supply pressure from a fluid feed pump to the operating connections A or B. Consequently, bores in the rotary actuator which run the supply pressure from the fluid feed pump to the pressure medium connection P within the rotary actuator are not necessary. Such boreholes in particular through the rotor of the rotary actuator increase fabrication complexity and weaken the rotor. Consequently, the hydraulic fluid is run through the hollow piston in a particularly advantageous manner.

The hydraulic valve includes a borehole with steps with operating connections A, B originating from the borehole. A pressure balanced hollow piston is axially movable within the borehole. The hollow piston is fitted in a sealing manner with a first exterior diameter within the bore section and axially movable. The hollow piston includes the following adjacent to this first outer diameter:

an enveloping surface with a large outer diameter in an axial portion of a first operating connection, and an enveloping surface with a small outer diameter in the portion of the other operating connection.

One respective inlet edge and one respective outlet edge originate from both enveloping surfaces. The two inlet edges are oriented away from one another. The outlet edges are oriented towards one another so that a supply pressure introduced into a cavity of the hollow piston contacts on the one hand side a projected circular surface. The circular surface is formed by a small outer diameter, so that a force is active in an axial direction. On the other hand side, the supply pressure contacts a projected annular surface. The annular surface is formed from the large outer diameter minus the first outer diameter.

Since the circular surface equals the annular surface, the hollow piston is pressure balanced.

In order to provide precise pressure balancing, both surfaces are at a certain ratio relative to one another. The circular surface formula yields the following for the three associated exterior diameters D1, D2, D3 of the piston:

$$D1=4\times K$$

$$D2=5\times K$$

$$D3=3\times K$$

Thus, K is an arbitrary constant. The outer diameter D1 is the small diameter. The outer diameter D2 is the large outer diameter. The outer diameter D3 is the first outer diameter. Thus, the annular surface is formed from the circular surface difference at the two outer diameters D2, D3.

One or two bypass connections A1, B1 can be provided in addition to the two operating connections A, B. Thus, a method according to DE 10 2006 012 733 A1 is implemented which provides hydraulic fluid to the rotary actuator for rotary movements, wherein the hydraulic fluid flows to the tank outlet through check valves.

The hydraulic valve does not have to be arranged as a central hydraulic valve radially within the rotary actuator. The arrangement of the pressure medium connection P axially adjacent to the operating connections A, B instead of being between the operating connections A, B also has advantages for an external or decentralized arrangement of the hydraulic valve. For such external arrangement, the hydraulic valve is attached for example

- in a cylinder head,
- in a cylinder head cover,
- in an intermediary plate or intermediary spacer between the cylinder head and the rotary actuator, or
- in a cover arranged in front of the rotary actuator.

An application for a decentralized arrangement is particularly advantageous since decentralized hydraulic valves typically include an electromagnetic control element mechanically coupled to the hydraulic valve. An electromagnetic control element of this type includes a pressure balanced magnetic armature. For pressure compensation, the magnetic armature includes a recess which connects the motion cavity in front of the magnetic armature with the motion cavity behind the magnetic armature. The magnetic armature moves in an armature cavity which is connected to a tank drain of the hydraulic valve. Since no substantial pressure originates from the tank drain, the motion cavities are free from pressure and the control element is not pressed away from the hydraulic valve. On the other hand side, a hydraulic valve with a connection cavity at both axial ends, for example in the sequence P-B-T-A-P, would load the movement cavities with the supply pressure so that the control element and the hydraulic valve would be pressed away from one another. Thus, the decentralized configuration of the hydraulic valve according to the invention combines the advantages:

- short axial installation space for the hydraulic valve, and
- connection of the control element without force transfer.

The hollow piston is axially supported in the stepped bore. This borehole can be machined in a particularly advantageous manner in the socket of a cartridge valve. However, the borehole can also be arranged in a housing. In a particularly advantageous embodiment, the bore is machined directly into a central screw which threads a rotor of the rotary actuator into a cam shaft.

Additional advantages of the invention can be derived from the additional patent claims and the drawing.

BRIEF DESCRIPTION OF THE DRAWINGS

The invention is subsequently described in more detail based on three embodiments with reference to drawing figures, wherein.

DETAILED DESCRIPTION OF THE INVENTION

Figure 1:
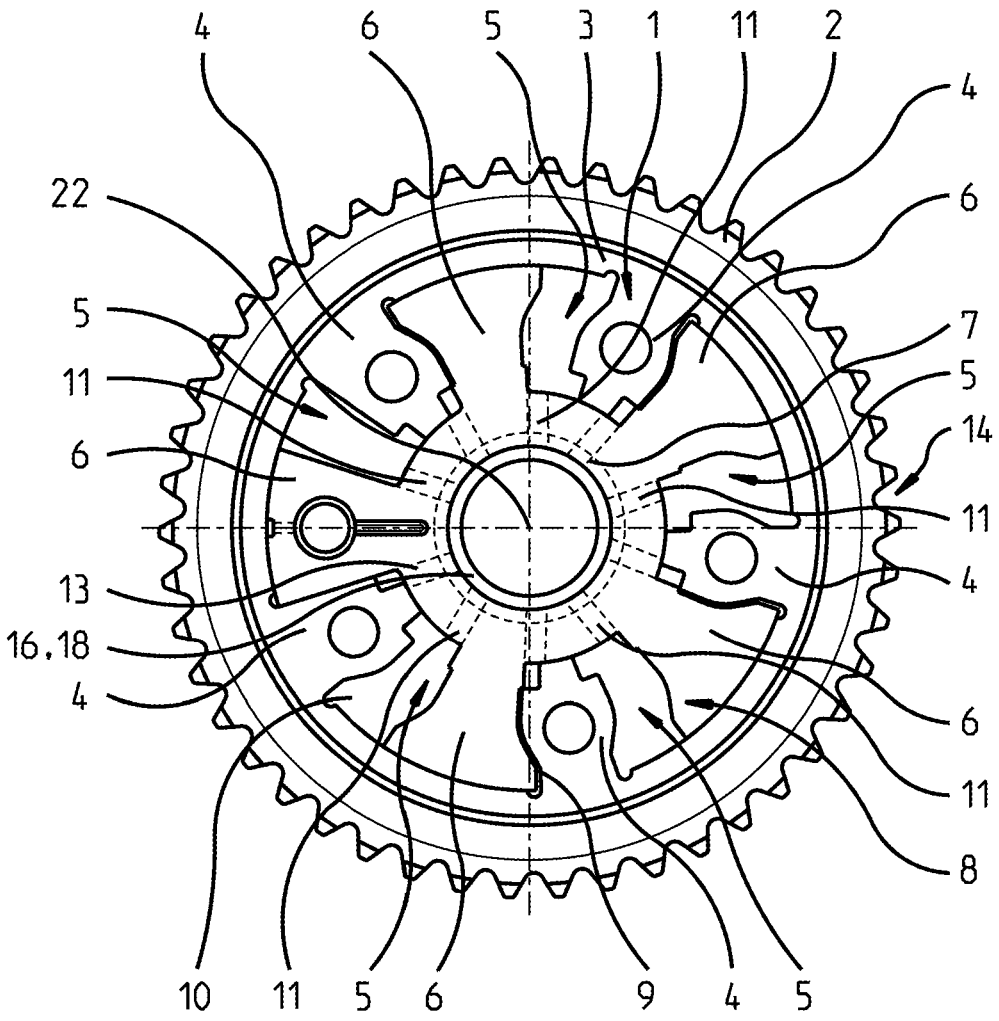
FIG. 1 illustrates a sectional view of a rotary actuator.

A rotary actuator 14 according to FIG. 1 is used for continuously adjusting an angular position of a cam shaft 18 relative to a drive gear 2 during operations of an internal combustion engine. Rotating the cam shaft 18 moves the opening and closing times of the gas flow control valves so that the internal combustion engine develops optimum power at a particular speed. The rotary actuator 14 includes a cylindrical stator 1 which is connected torque proof with the drive gear 2. In this embodiment, the drive gear 2 is a chain sprocket over which a chain is run which is not illustrated in detail. The drive gear 2 can also be a timing belt gear over which a timing belt is run as a drive element. The stator 1 is connected with a crank shaft through the drive element and the drive gear 2.

The stator 1 includes a cylindrical stator base element 3 from whose inside bars 4 extend radially inward with uniform offsets. Between adjacent bars 4, intermediary cavities 5 are formed through which pressure medium is introduced controlled by a centrally arranged hydraulic valve 12 that is illustrated in more detail in FIG. 2. Between adjacent bars 4, wings 6 protrude which extend in radially outward direction from a cylindrical rotor hub 7 of a rotor 8. The wings 6 divide the intermediary cavities 5 between the bars 4 respectively into two pressure cavities 9 and 10. One pressure cavity 9 is associated with the adjustment in advance direction, whereas the other pressure cavity is associated with the adjustment in retard direction.

The bars 4 contact an outer enveloping surface of the rotor hub 7 with their faces in a sealing manner. The wings 6 in turn contact the cylindrical inner wall of the stator base element 3 with their faces in a sealing manner.

The rotor 8 is connected torque proof with the cam shaft 18. In order to change the angular position between the cam shaft 18 and the drive gear 2, the rotor 8 is rotated relative to the stator 1. For this purpose, the pressure medium in the pressure cavities 9 or 10 is pressurized based on a desired rotation direction, whereas the respective other pressure cavities 10 or 9 are unloaded towards the tank T. In order to rotate the rotor 8 relative to the stator 1 counterclockwise into the illustrated position, an annular first rotor channel 19 in the rotor hub 7 is pressurized by the hydraulic valve 12. From this first rotor channel 19, additional channels 11 lead into the pressure cavities 10. This first rotor channel 19 is associated with the first operating connection A. In order to rotate the rotor 8 clockwise, a second annular rotor channel 20 in the rotor hub 7 is pressurized by the hydraulic valve 12, wherein the channels 13 lead into the annular rotor channel 20. This second rotor channel 20 is associated with the second operating connection B. The two rotor channels 19, 20 are arranged axially offset from one another with respect to a central axis 22, so that the two rotor channels 19, 20 are arranged in the drawing plane of FIG. 1 one behind the other shadowing each other.

The rotary actuator 14 is placed onto the cam shaft 18 which is configured as a hollow tube 16. Thus, the rotor 8 is placed onto the cam shaft 18. The hollow tube 16 includes boreholes 23, 24 which connect the two rotor channels 19, 20 associated with the two operating connections A, B hydraulically with transversal boreholes 25, 26 in a bushing 27 of the hydraulic valve 12.

Figure 2:
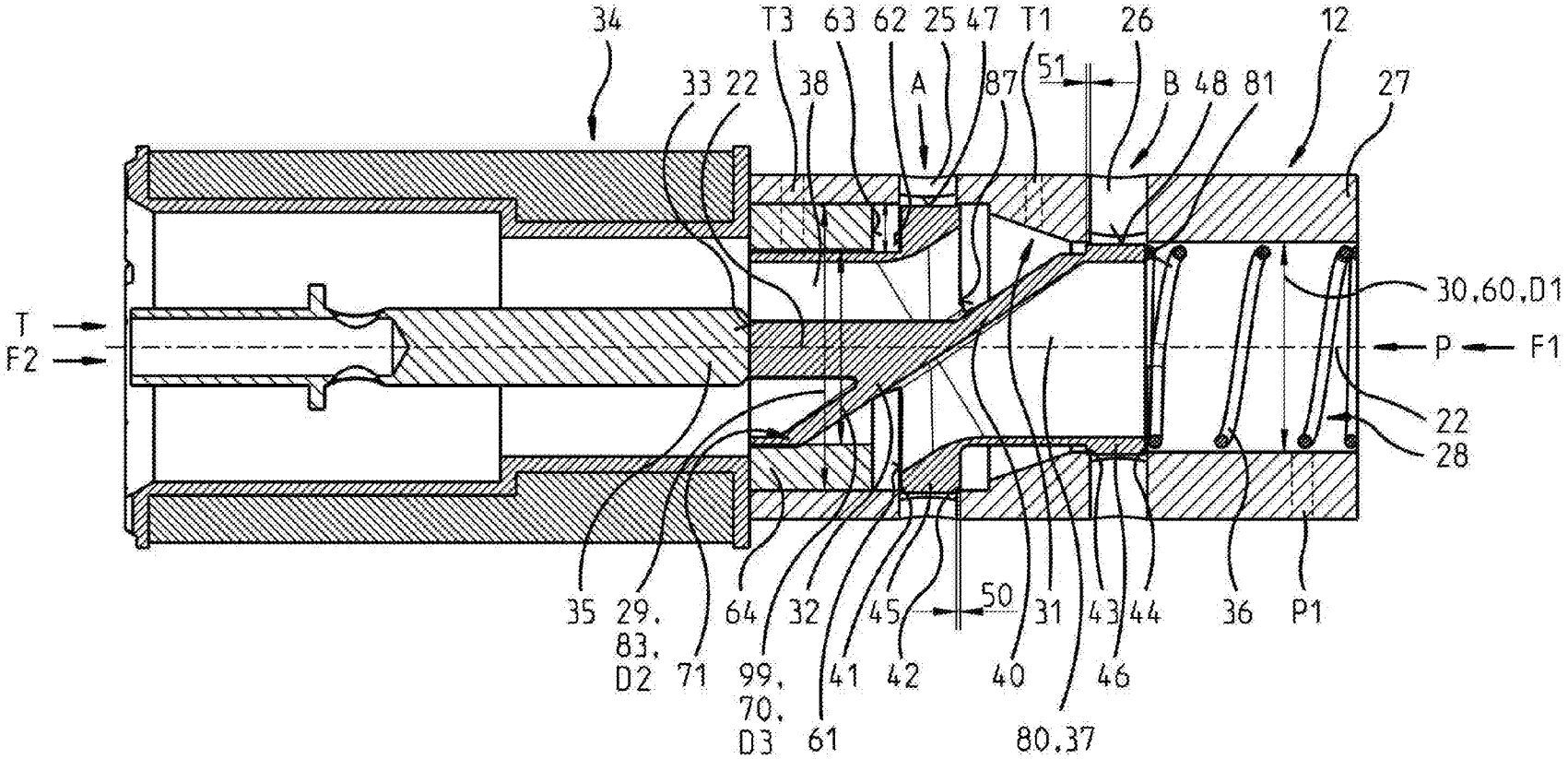
FIG. 2 illustrates a sectional view of an electromagnetic control element of a hydraulic valve which is used in a rotary actuator.

Thus, the rotary actuator 14 is rotatable through the hydraulic valve 12 that is visible in FIG. 2.

The central borehole 28 within the bushing 27 includes two different inner diameters 29, 30 which transition into one another through a conical bore portion 31. The first transversal borehole 25 of the bushing 27 originates from the larger inner diameter 29 and is thus associated with the first operating connection A. The second transversal borehole 26 of the bushing 27 originates from the smaller inner diameter 30 and is thus associated with the second operating connection B. A hollow piston 32 is movable within the bushing 27. Thus, the hollow piston 32 includes a frontal contact surface 33 for an electromagnetic control element 34. A pushrod 35 of the electromagnetic control element 34 contacts the contact surface 33 at its center. A compression coil spring 36 contacts the hollow piston 32 at its other face, wherein the compression coil spring is supported at a support element of the bushing 27. Thus, the compression coil spring 36 contacts an annular face 81 of the hollow piston 32. Thus, the hollow piston 32 is movable by the electromagnetic control element 34 against a spring force of the compression coil spring 36 in axial direction relative to the bushing 27. The hollow piston 32 includes an inlet channel 37 and an outlet channel 38. The inlet channel 37 is a cavity 80 within the hollow piston 32 and leads through the central bore 28 in the portion of the small inner diameter 30 to a pressure medium connection P axially introduced into the bushing 27. On the other hand side, the outlet channel 38 leads to the tank outlet T. The separation of the inlet channel 37 from the outlet channel 38 is provided through a wall 40 within the hollow piston 32, wherein the wall extends substantially at a slant angle. This slanted extension separates four control edges 41, 42, 43, 44. The control edges 41, 42, 43, 44 are arranged at annular bars 45, 46 radially extending from the hollow piston 32. The two annular bars 45, 46 are axially offset from one another. The annular bar 45 that is more proximal to the control element 34 includes an enveloping surface 47 with a large outer diameter D2 and is supported in the central bore 28 in the portion of the greater inner diameter 29. The annular bar 46 that is more remote from the control element 34 includes an enveloping surface 48 with a small outer diameter D1 and is supported in the central borehole 28 in the portion of the small inner diameter 30. The two control edges 42, 43 define sides of the annular bar 45, 46 that are oriented towards one another. The two other control edges 41, 44 define sides of the annular bars 45, 46 that are oriented away from one another.

The outlet channel 38 leads from the two control edges 42, 43 that are oriented towards one another to the tank outlet T. The inlet channel 37, however, leads to the two control edges 41, 42 that are oriented away from one another. Thus, the two control edges 42, 43 that are oriented towards one another form outlet edges, wherein the control edges 41, 44 that are oriented away from one another form inlet edges.

In the locking central position of the hydraulic valve 12 illustrated in FIG. 2, the two control edges 42, 43 that are oriented towards one another have a relatively large overlap 50, 51 with the bushing 27. On the other hand side, the two control edges 41, 44 oriented away from one another do not have any overlap with the bushing 27 in this locking central position of the hydraulic valve 12. Thus, it is assured according to the principle of outlet edge control that the rotor 8 is loaded relative to the stator 1 in a particular angular position. The principle of outlet edge control is described in more detail in DE 198 23 619 A1.

A first outer diameter D3 of the hollow piston 32 is fitted in a sealing manner in a bore section 71 and movable. This bore section 71 is formed by a sleeve 64 which is permanently connected with the bushing 27. Thus, the sleeve 64 is pressed into the bushing 27. The first outer diameter D3 of the hollow piston 32 essentially corresponds to a first inner diameter 70 of the sleeve 64. After the first outer diameter D3, the following elements are arranged in an axial direction oriented from the control element 34 towards the pressure medium connection P:

- the enveloping surface 47 with the large outer diameter D2 in the axial portion of the one operating connection A and
- the jacket surface 48 with a smaller outer diameter in the axial portion of the other operating connection B.

The hollow piston 32 is pressure balanced in a particularly advantageous manner so that position controls of the rotary actuator can be performed with high quality. Thus, the axial forces acting upon the hollow piston 32 balance each other. This means, the force F1 acting in the drawing in a left direction is independent from the supply pressure at the pressure medium connection P and equal to the force F2 that acts in a direction towards the right.

A supply pressure introduced by the pressure medium connection P into the inlet channel 37 of the hollow piston 32 has full surface contact with a projected circular surface 60. The circular surface 60 is formed by a smaller outer diameter D1 of the hollow piston 32. The circular surface 60 is projected by an annular face 81 and the slanted wall 40 onto the plane orthogonal to the central axis 22. This generates the force F1 acting upon the control element 34. The opposite force F2 acts through the supply pressure upon an annular surface 61 which is formed by the circular surface 83 at the large exterior diameter minus a circular surface 99 at the first exterior diameter D3. As apparent from the lower drawing half of FIG. 2, the annular surface 61 forms from this difference as a surface that is projected onto the plane perpendicular to the central axis 22.

The smaller inner diameter 30 of the bushing 27 essentially corresponds to the smaller outer diameter D1 at the enveloping surface 48. Thus, the smaller outer diameter D1 essentially defines the circular surface 60 which when multiplied with the pressure at the pressure medium connection P predetermines the force F1 acting in axial direction, in the drawing to the left. The force F2 acting in opposite direction is defined by an annular surface 61 which is formed at a face 63 of the sleeve 64 pressed into the bushing 27. The face 63 is arranged opposite to a face 62 of the annular bar 45.

Thus, the inlet channel 37 provides a hydraulic connection between the circular surface 60 and the annular surface 61. The circular surface 60 and the annular surface 61 have identical sizes for pressure balancing. Thus, a freedom from force is provided which facilitates position control for the control element in particular in the illustrated center position. Controlling is performed from this center position or locked center position. Short period small movements from the locked center position and back into the locked center position rotate the rotor 8 clockwise or counterclockwise.

FIG. 2 illustrates the connection sequence or port sequence P-B-A-T. Therefore, the sequence is as follows:

pressure medium connection P,
first operating connection B,
other operating connection A, and
the tank outlet T.

Thus the supply connection P is provided in axial manner. In FIG. 2, two additional alternative connection options are illustrated in dashed lines. Thus, the outlet towards the tank can be configured as tank outlet T1 instead of tank outlet T. Thus, this tank outlet T1 is arranged axially between the two operating connections A, B. In this case, the outlet channel 38 towards the tank outlet T can also be closed according to the dashed line 87.

It is also alternatively feasible to arrange the axial connections radially in that a recess is provided in the bushing or in the hollow piston 32. This is illustrated with reference to the supply connection P1 or the tank outlet T3.

In an alternative embodiment, the shoulder is not implemented through the sleeve 64. Instead, another configuration can be provided which provides assembling capability. The bushing 27 can be configured for example as a two-piece threaded component which includes a one-piece shoulder instead of the sleeve 64. Thus, the threading level provides assembly capability for the component.

Instead of the bushing, a borehole can also be provided within a housing.

In an alternative embodiment, the pressure medium connection P is not axially introduced into the bushing 27. Instead, the pressure medium connection P is introduced in a radial direction. Thus, for example a transversal borehole or recess can be provided in the wall of the bushing 27. This transversal borehole is then arranged in the axial portion of the compression coil spring 36.

According to the embodiment, the hydraulic valve can be provided as a central hydraulic valve which is also designated as central valve. However, it can also be configured as a decentralized hydraulic valve. The hydraulic valve can also be configured as cartridge hydraulic valve.

Figure 3:
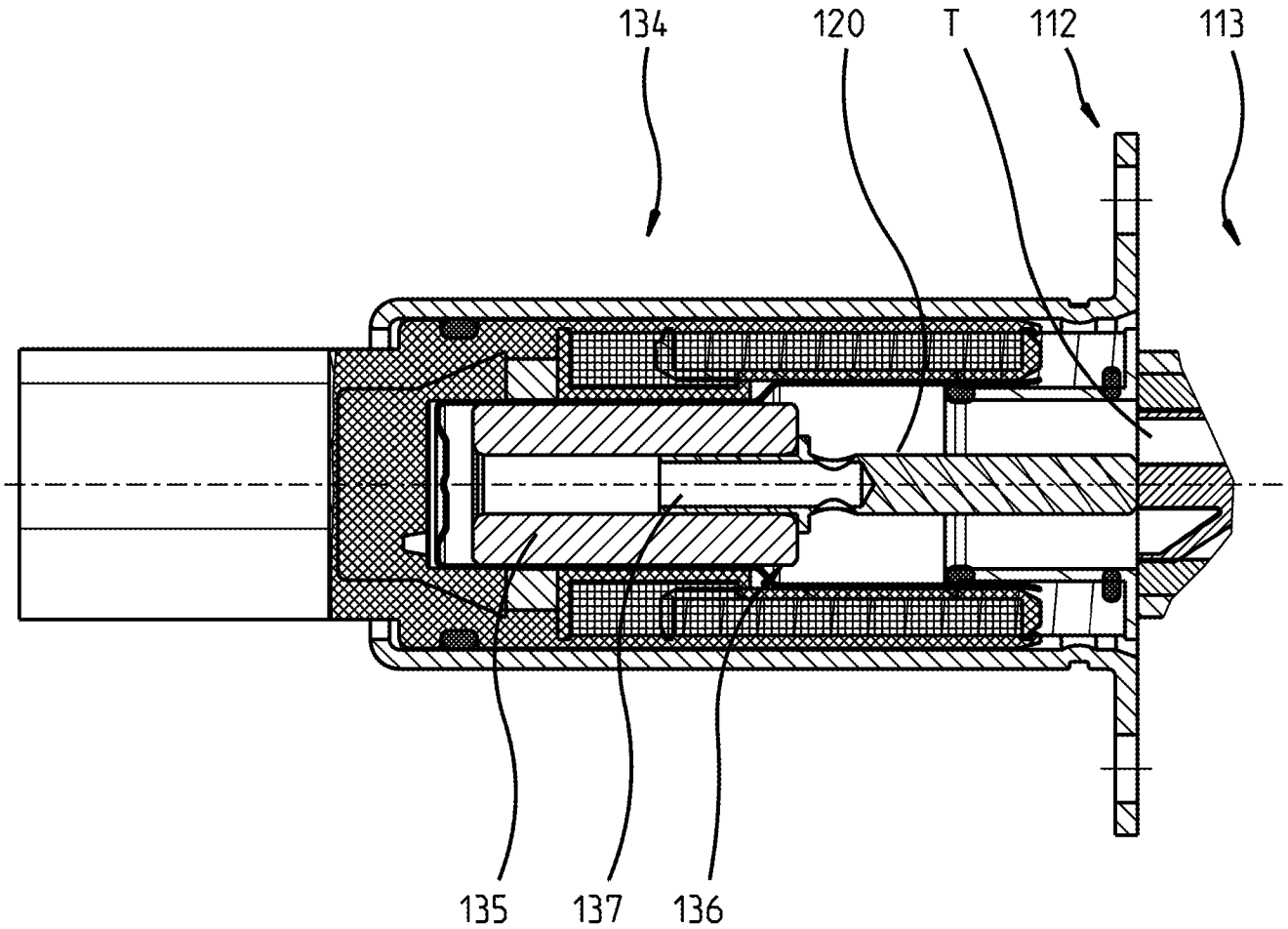
FIG. 3 illustrates a sectional view of a hydraulic valve which is used in a rotary actuator.

FIG. 3 illustrates the electromagnetic control element 134 for a decentralized hydraulic valve 112 with a hydraulic portion 113 that is only partially illustrated. This control element 134 is internally pressure balanced. Therefore, the tank outlet T is connected by a channel 120 with an annular cavity 136 within the control element 134 in which an armature magnet 135 is arranged axially movable. The armature magnet 135 includes a recess 137 through which the armature magnet 135 is pressure balanced. Since no substantial pressure comes from the tank outlet T, the movement spaces of the armature magnet 135 are free from pressure and the control element 134 is not pressed away from the hydraulic portion 113.

On the other hand side, a hydraulic portion of a hydraulic valve with a control connection P at both axial ends, for example in the sequence P-B-T-A-P, would load the movement cavities with the supply pressure so that the control element and the hydraulic valve would be pressed away from one another.

The cam shaft can be for example an assembled cam shaft.

The tank outlets do not have to be arranged at face sides. Thus, it is also feasible to configure the tank outlets as radial boreholes in the piston and/or in the bushing.

The hydraulic valve can be configured as a central valve within the rotor hub or within a central recess of the cam shaft. Thus, the cam shaft can be an assembled cam shaft in which the cams are placed onto a tube.

An electromagnetic control element for a central valve does not have to be configured according to FIG. 2. It is feasible in particular to prevent problems due to the rotating movement of the contact surface 33 relative to the plunger 35 in that the plunger 35 is rounded and contacts the contact surface 33 only in particular points. It is also feasible to terminate the plunger 35 with a bearing ball which contacts the contact surface 33. An electromagnetic control element with a bearing ball for a central valve is illustrated for example in DE 10 2010 060 180 A1.

Alternatively, it is also feasible to configure the hydraulic valve as a remote valve or as a decentralized hydraulic valve.

The pressure for adjusting the rotary actuator can come from a fluid feed pump. This fluid feed pump can be in particular an oil pump for providing lubricants in the internal combustion engine. However, when a relatively high pressure shall be supplied for a high adjustment speed of the rotary actuator, the fluid feed pump can be associated only with the rotary actuator, or the rotary actuator and other hydraulic units. In this case, the fluid feed pump can be configured for example as a vane pump. Alternatively gear pumps, radial piston pumps, and crescent pumps can be implemented.

It is appreciated that the designation of the two operating connections with the letters A or B is exchangeable at will.

The piston can be made from metal or from plastic material. The plastic material is injection molded. When using plastic material, a fiber reinforced plastic material is advantageous as already illustrated in the non-prepublished DE 10 2007 026 831.

In order to produce the piston, a tool with slides can be used.

The described embodiment is provided for illustration purposes. A combination of the described features can be provided in different embodiments. Additional, in particular non-described features of devices that form part of the invention can be derived from the geometries of components illustrated in the drawings.

What is claimed is:

1. A rotary actuator, comprising:

a hydraulic valve including a borehole with shoulders. and a first operating connection and a second operating connection originating from the borehole, wherein a pressure balanced hollow piston is arranged axially movable in the borehole, wherein the hollow piston is fitted with a first outer diameter in e borehole section in a sealing manner, wherein the hollow piston includes the following axially subsequent to the first outer diameter in a first axial direction:

an enveloping surface with a large outer diameter in an axial portion of the first operating connection, and an enveloping surface with a small outer diameter in an axial portion of the second operating connection, wherein an inlet edge and an outlet edge extends from each of the first enveloping surface and the second enveloping surface, wherein the two inlet edges are oriented away from one another and the two outlet edges are oriented towards one another so that a supply pressure introduced into a cavity of the hollow piston loads a projected circular surface which is formed by the small outer diameter so that a force is effective in a second axial direction that is opposite to the first axial direction, wherein the supply pressure loads a projected annular surface which is formed by the large outer diameter minus the first outer diameter such that a force is effective in the first axial direction.

2. The rotary actuator including the hydraulic valve according to claim 1, wherein the supply pressure loads the entire projected circular surface.

3. The rotary actuator including the hydraulic valve according to claim 1, wherein a surface area of the projected circular surface is identical to a surface area of the projected annular surface.

4. The rotary actuator including the hydraulic valve according to claim 1, wherein the two operating connections are arranged axially subsequent to the pressure medium connection in the second axial direction, wherein the tank outlet is arranged axially subsequent to the two operating connections in the second axial direction.

5. The rotary actuator including the hydraulic valve according to claim 4, wherein the hydraulic valve is configured as a central valve within a rotor hub, wherein the supply pressure is provided to the hollow piston axially from a cam shaft configured as a hollow tube.

6. The rotary actuator including the hydraulic valve according to claim 1, wherein the first operating connection is arranged axially subsequent to the pressure medium connection in the second axial direction, wherein a tank outlet is arranged axially subsequent to the first operating connection in the second axial direction, wherein the second operating connection is arranged axially subsequent to the tank outlet in the axial second direction.

7. The rotary actuator including the hydraulic valve according to claim 1, wherein a sleeve is provided in a borehole section for producing the first outer diameter, wherein the sleeve is fixated in the borehole, so that the hollow piston is insertable into the borehole section before the sleeve is installed.

8. The rotary actuator including the hydraulic valve according to claim 1, wherein an inlet channel is separated from an outlet channel within the hollow piston through a wall within the hollow piston, wherein the wall extends at a slant angle, wherein the slanted extension of the wall separates four control edges which are arranged at annular bars radially extending from the hollow piston, wherein an annular bar that is more proximal to a control element includes the enveloping surface with the large outer diameter, wherein the annular bar that is more proximal to the control element is supported in the central borehole in a portion of a large inner diameter, wherein an annular bar that is more remote from the control element includes the enveloping surface with the small outer diameter and is supported in the central borehole in a portion of a small inner diameter.

9. The rotary actuator including the hydraulic valve according to claim 1, wherein the hydraulic valve is configured as a decentralized hydraulic valve whose electromagnetic control element includes a magnetic armature with a recess for internal pressure balancing.

10. The rotary actuator including the hydraulic valve according to claim 1, wherein the small outer diameter is four times a constant, wherein the large outer diameter is five times the constant, and wherein the first outer diameter is three times the constant.

11. A rotary actuator, comprising:

a hydraulic valve including a borehole with shoulders, and a first operating connection and a second operating, connection' originating from the borehole, wherein a pressure balanced hollow piston is arranged axially movable in the borehole, wherein the hollow piston is fitted with a outer diameter in a borehole section in a sealing manner, wherein the hollow piston includes the following axially subsequent to the first outer diameter in a first axial direction:

an enveloping surface with a large outer diameter, and an enveloping surface with a small outer diameter in an axial portion of the second operating connection, wherein a supply pressure introduced into a cavity of the hollow piston loads a projected circular surface which is formed by the small outer diameter so that a force is effective in a second an axial direction that is opposite to the first axial direction, wherein the supply pressure loads a projected annular surface which is formed by the large outer diameter minus the first outer diameter such that a force is effective in the first axial direction.

* * * * *